US005333601A

United States Patent [19]

Hill

[11] Patent Number: 5,333,601

[45] Date of Patent: Aug. 2, 1994

[54] MASONRY HEATER

[75] Inventor: Kerry Hill, Wainfleet, Canada

[73] Assignees: Christy Brianna Hill; Andrea Kirsty Lee Hill, Wainfleet, Canada

[21] Appl. No.: 27,493

[22] Filed: Mar. 5, 1993

[51] Int. Cl.[5] ..... F24B 1/188

[52] U.S. Cl. ..... 126/523; 126/500; 126/503; 126/8

[58] Field of Search ..... 126/523, 500, 502, 503, 126/512, 8

[56] References Cited

U.S. PATENT DOCUMENTS

| | | | |
|---|---|---|---|
| 773,920 | 11/1904 | Boulger | 110/210 |
| 4,466,420 | 8/1984 | Ernisse et al. | 126/9 B X |
| 4,730,598 | 3/1988 | Swinton | 126/80 |
| 4,827,900 | 5/1989 | Bonner | 126/80 X |
| 5,014,680 | 5/1991 | Siemer | 126/80 X |

OTHER PUBLICATIONS

"Clean Efficient Masonry Heating The Intelligent Alternative" (brochure).
"Temp-Cast 2000" (brochure).
"TuliKivi TU 800" (brochure).
"Finnish Fireplace Construction Manual 1984", Albert A. Barden, III, pp. 53-57.
"Finnish Fireplaces, Heart of the Home", A. Barden et al., pp. 33, 41, 51 and 101.
Brochure by Hearth Warmers.
Brochure by Dietmeyer, Ward & Stroud, Inc.

*Primary Examiner*—Larry Jones
*Attorney, Agent, or Firm*—Riches, McKenzie & Herbert

[57] ABSTRACT

This invention relates to A contra-flow masonry heater comprising: a firebox having a front opening, an air intake communicating with a source of fresh air and an upper flue outlet; at least one vertical contra-flow heat exchange channel communicating between the flue outlet and an exhaust port, the firebox and channel having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air; and an air tight door secured to the front opening of the firebox.

15 Claims, 14 Drawing Sheets

MASONRY HEATER

FIELD OF THE INVENTION

The invention relates to masonry heaters, and in particular a thermostatically controlled gas fired masonry heater.

BACKGROUND OF THE INVENTION

Masonry heaters have been used at least since Roman times to provide radiant heat from a mass of masonry. A conventional masonry heater includes a firebox and a series of maze like channels through which the flue gases escape to the chimney. The firebox and channels have walls preferably made of refractory material which absorbs heat energy from the burning fuel and combustion gases. The primary advantage of a masonry heater is that a relatively small amount of fuel may be burned for a short period of time and the mass of the masonry heater absorbs a significant portion of the heat energy from such a fire. The masonry mass thereafter radiates heat to the surrounding room over a long period of time.

A contra-flow masonry heater conventionally has a central firebox with air intake and upper flue outlet. Vertical contra-flow heat exchange channels communicate with the flue outlet at the top of the firebox and direct the combustion gases downward in the channels to be exhausted through an exhaust port at a lower level. A contra-flow masonry heater is preferred since a larger portion of the heat energy may be absorbed by the masonry mass. The heat of combustion is high enough to avoid the buildup of creasole and other combustible products in the channels.

In Europe, masonry heaters have been conventionally built where a wood burning fireplace is desired. The size of the masonry heaters is relatively large and they are often located in the center of a home to provide radiant heating throughout the dwelling.

In North America, conventionally an open hearth fireplace has been used, however, in recent years due to the inefficiencies of such fireplaces, their use has been discouraged. A conventional fireplace is very inefficient in that it draws room air for combustion and although radiant heat is felt in the immediate vicinity of the fireplace, in total the heat output of many fireplaces is negative. In other words, the draft caused by the operation of the fireplace exhausts warm air from the dwelling and draws in cold air through doorways, windows and other openings of the dwelling. In modern home construction, insulation and vapor barriers are continuously provided to substantially increase the heating efficiency of the dwelling. A fireplace in such a dwelling represents a major source of heat loss, however, since many members of the purchasing public still desire a wood burning fireplace in their homes, the level of energy efficiency is less than optimal in modern construction. When a gas burning insert is placed in a conventional fireplace, the heat efficiency is not substantially higher than when wood is burned in a conventional fireplace. As a result, such gas inserts are largely decorative and are not a practical source of heat for a dwelling despite the quantity of gas burned in such applications.

Attempts have been made to combine the efficiency of a masonry heater to replace a conventional fireplace with the addition of a gas burning insert. Such attempts have been unsuccessful to date. Due to the contra-flow design there is a dangerous potential for non combusted gas to accumulate in the upper regions of the contra-flow masonry heater. As a result, such gas fire contra-flow heaters must be operated with the doors open and may not include a chimney damper. Inefficient burning of the gas fuel results, however the problem of accumulation of dangerous gases is avoided. A significant danger still is presented by such an application since the home owner may forget to leave the doors open or may instal a damper without knowing the inherent dangers of such a modification.

The design of conventional masonry heaters also often requires that expansion gaskets be installed between various parts of the firebox and heat exchange channels due to the differential in temperature during operation and relative expansion and contraction. Gaskets and cracks in the masonry heater may be acceptable in a wood burning application, however the danger of carbon monoxide poisoning or explosive gases is present when used in conjunction with a gas burner. Another disadvantage of conventional masonry heaters is that they are of a size which requires the removal of an existing fireplace to install a masonry heater. This is not a particular difficulty with the construction of a new home, however the market potential of masonry heaters is significantly restricted by its inability to be adapted to retro fit in a conventional fireplace.

SUMMARY OF THE INVENTION

The invention overcomes the disadvantages of the prior art in a novel manner in the provision of a contra-flow masonry heater which can be adapted to burn wood fuel or to include a gas burner. A down draft hood is provided to prevent down draft in the chimney from exhausting carbon dioxide and fuel gas into the dwelling. Such a down draft hood prevents the serious problem of backflow through the air intake.

The contra-flow masonry heater of the invention includes burner control means which operate with a thermostat in contact with a masonry core. Depending upon the temperature setting of the thermostat and the temperature of the core after burning of the fuel and heat absorption, the burner control means may be stimulated to ignite the burner flame, extinguish the flame, or vary the quantity of gas supplied to the burner to achieve the desired room temperature. As described above, conventional gas fired masonry heaters have not been thermostatically controlled since for safety reasons they are required to be operated with the doors open and cannot include a damper.

The relief port of the down draft hood exhausts into the same dwelling space from which the intake air is drawn. Temperature sensor means are located within the relief port and communicate with the burner control means. When a temperature higher than a prescribed value is sensed by the temperature sensor, it stimulates the burner control means to extinguish the burner. Such a rise in temperature would occur when down draft through the chimney forces flue gases down the chimney and through the relief port. Without such a relief port or down draft hood, the flue gases would be forced back into the masonry heater and possibly backwards into the dwelling area through the intake port. The danger of carbon monoxide poisoning, poisoning from fuel gas, explosion or fire hazard are eliminated through the invention.

As a result of the unique design of the system, it has been tested as a vented room heater through the American Gas Association Laboratories and has received certification and full approval under ANSI Standard Z21.11.1-1991. To the knowledge of the inventor such gas approval has been obtained by any other designer of gas fired masonry heaters. The efficiency of a gas fired masonry heater in accordance with the invention is such that it may be made of such a size to fit within the hearth of a conventional fireplace. As a result, the masonry heater may be retro fit within an existing fireplace thereby substantially increasing the potential for marketplace acceptance.

The core of the masonry heater is constructed of modular blocks in a vertically stacked series of courses. Every block is of the same vertical height and the walls of the blocks have substantially the same thickness. As a result it has been found through experiment that expansion gaskets are not required between the modular blocks and only high temperature refractory mortar is required. Expansion and contraction and differential temperature between the firebox and contra-flow channels is such that leakage of gas and expansion cracks do not occur.

A further advantage of the modular design is that any height of masonry heater may be constructed from a limited number of standard blocks. For example, upper blocks may be added to a simple contra-flow masonry heater to add a secondary combustion chamber above the firebox and to increase the heat transfer to the masonry mass through an extended exhaust route. Further addition of blocks may result in the formation of a tertiary combustion chamber and so forth. As with conventional masonry heaters, the larger the masonry mass that is available to store heat energy, the greater the efficiency of heat transfer from the burning fuel to radiant heat in the dwelling.

A further advantage of the invention is the provision of a glass door with diverter plate to divert a portion of the intake air against the inward surface of the door. The increase of turbulance of air in the firebox increases the combustion efficiency. Also the diverted air creates an air wash which cools the surface of the glass and prevents the discolorization of the gas from contact with combustion gases.

Accordingly, the invention provides a contra-flow masonry heater comprising a firebox having a front opening, an air intake communicating with a source of fresh air and an upper flue outlet; at least one vertical contra-flow heat exchange channel communicating between the flue outlet and an exhaust port, the firebox and channel having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air; and an air tight door secured to the front opening of the firebox.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which.

DETAILED DESCRIPTION OF PREFERRED EMBODIMENTS OF THE INVENTION

Figure 1:
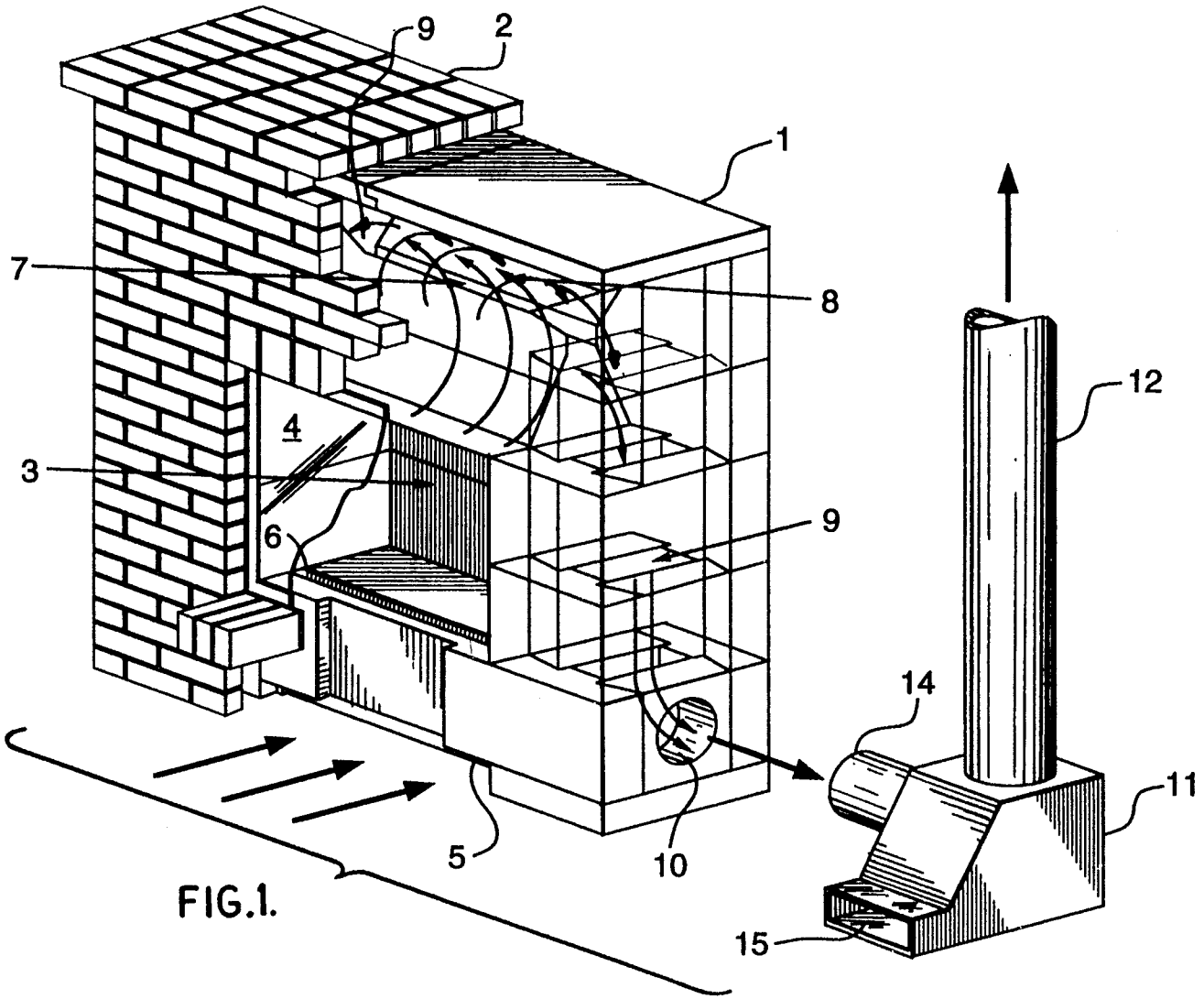
FIG. 1 is a partially broken away perspective transparent view of one embodiment of the invention adapted to burn wood fuel showing the flow of intake air and flue gases through the masonry heater and (to the right as drawn) through the down draft hood which is exploded away from the exhaust port for clarity.

FIG. 1 illustrates the general nature of the invention in relation to a masonry heater utilizing the contra-flow principal. The core of contra-flow masonry heater 1 is shown with a barick facade 2 partially broken away. The flow of air through the firebox, secondary combustion chamber, vertical heat exchange channels, exhaust port, and down draft hood is shown with the arrows through a transparent modular core assembly. The firebox 3 has a front opening to which is secured an airtight door 4. Fresh air from the room enters the heater through an air intake 5 and enters the firebox 3 through a slot 6 in the bottom floor of the firebox 3.

A fuel such as wooden logs as shown, is burnt within the firebox 3 and the combustion gases exit from the firebox through an upper flue outlet 7.

In the embodiment illustrated in FIG. 1, the firebox 3 includes a secondary combustion chamber 8 between the upper flue outlet 7 and the vertical contra-flow heater exchange channels 9 which communicate between the flue outlet 7 and an exhaust port 10.

As indicated by the arrows of FIG. 1, the burning fuel and combustion gases swirl within the firebox 3 and secondary combustion chamber 8. As the combustion gases transfer their heat to the mass of the masonry heater, the combustion gases cool and exit downwardly through the vertical contra-flow channels 9.

The masonry core 1 including the firebox 3, secondary combustion chamber 8, and vertical contra-flow heat exchange channels 9 all have walls of refractory material. The refractory material provides for mass absorption of heat energy from the burning fuel and combustion gases contained within the masonry heater core 1. After the refractory material has been heated, even after the fuel source has been extended, heat energy is radiantly released to the adjacent dwelling space.

The down draft hood 11 communicates between the exhaust port 10 and outside air via a chimney pipe 12.

Figure 3:
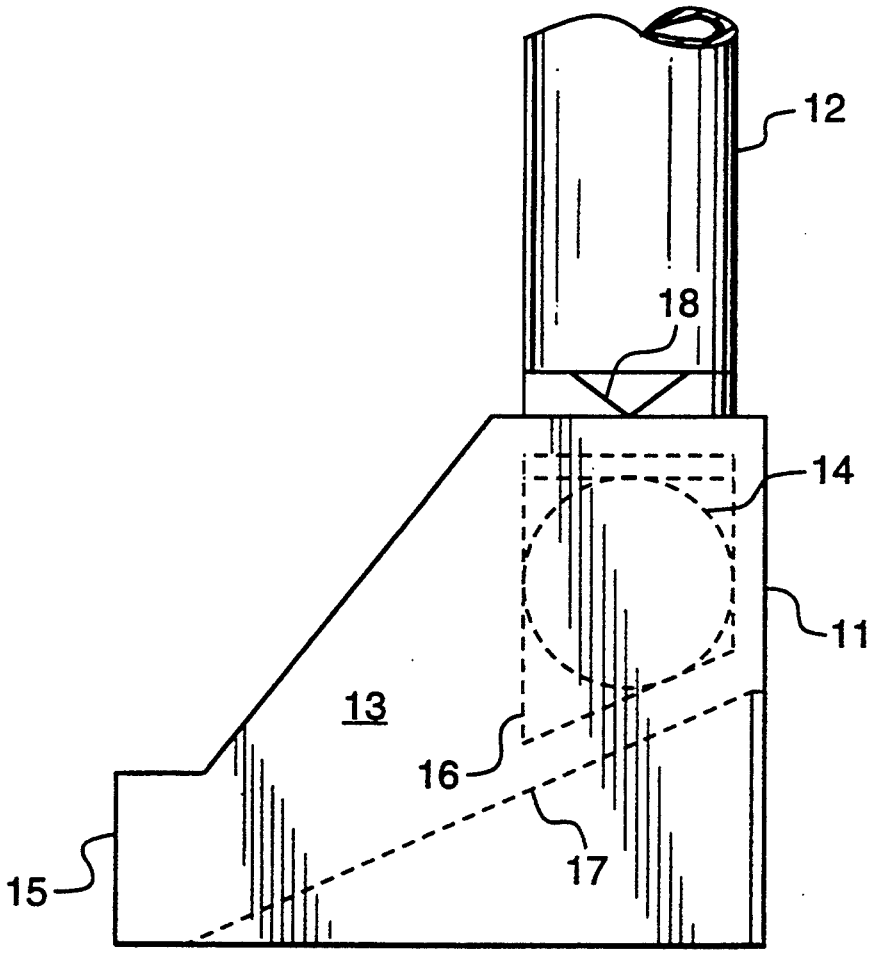
FIGS. 3 and 4 show details of the down draft hood in elevation and plan views respectively.
Figure 4:
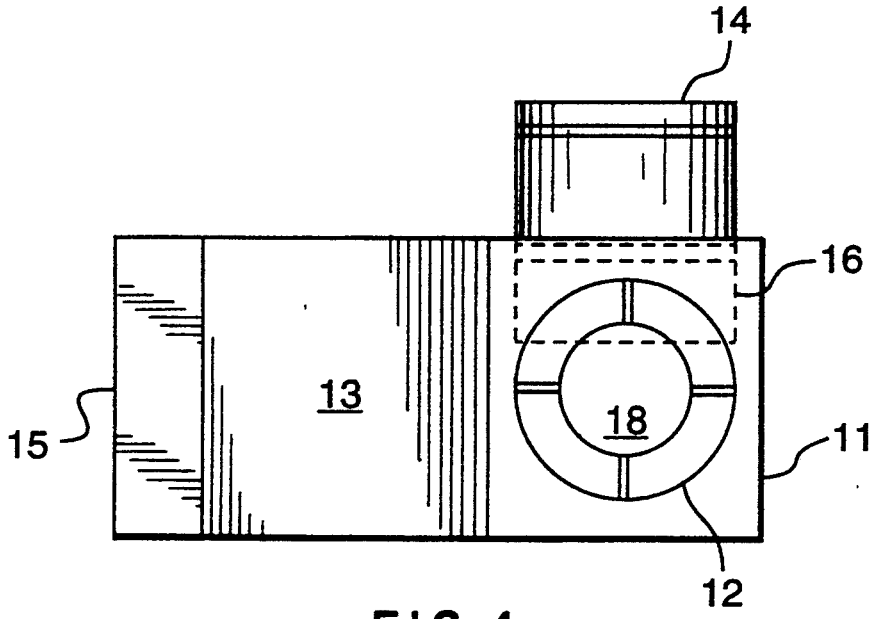

FIGS. 3 and 4 illustrate the detailed construction of the down draft hood 11. A sheet metal down draft hood as illustrated includes an internal plenum 13. The plenum communicates among an exhaust inlet 14, the chimney 12 and a relief port 15. The exhaust inlet 14 is secured within the exhaust port 10 of the masonry heater core 1. The relief port 15 is located below the elevation of the exhaust inlet 14 and communicates with a source of fresh air within the same area from which the intake air is drawn. A diverter plate 16 is positioned over the opening of the exhaust inlet 14 into the plenum 13. A baffle plate 17 also aids in the redirection of any downflow from the chimney 12. A cone 18 is centered in the draft hood chimney 12. Under normal operation therefore, the flue gases are exhausted through the exhaust port 10 into the exhaust inlet 14 and thereafter enter the plenum 13. Under normal circumstances, the heat of the exhaust gases forces them to rise up the chimney 12 and exhaust to the outside air. If however a down draft condition exists, outside air is drawn through the chimney 12 into the plenum 13. The down draft air is diverted by the diverter plate 16 and baffle plate 17 to prevent it from flowing into the masonry heater via the exhaust inlet 14. The exhaust gases are rather forced by the down draft outward through the relief port 15. As will be described in detail below, a temperature sensor is preferably located within the relief port 15 to extinguish fuel supply to the firebox when a gas burner is used. In the case of a wood burning masonry heater, a down draft condition would be detected by the occupants of the dwelling fairly quickly by smelling the smoke exhausted through the relief port 15.

Figure 2:
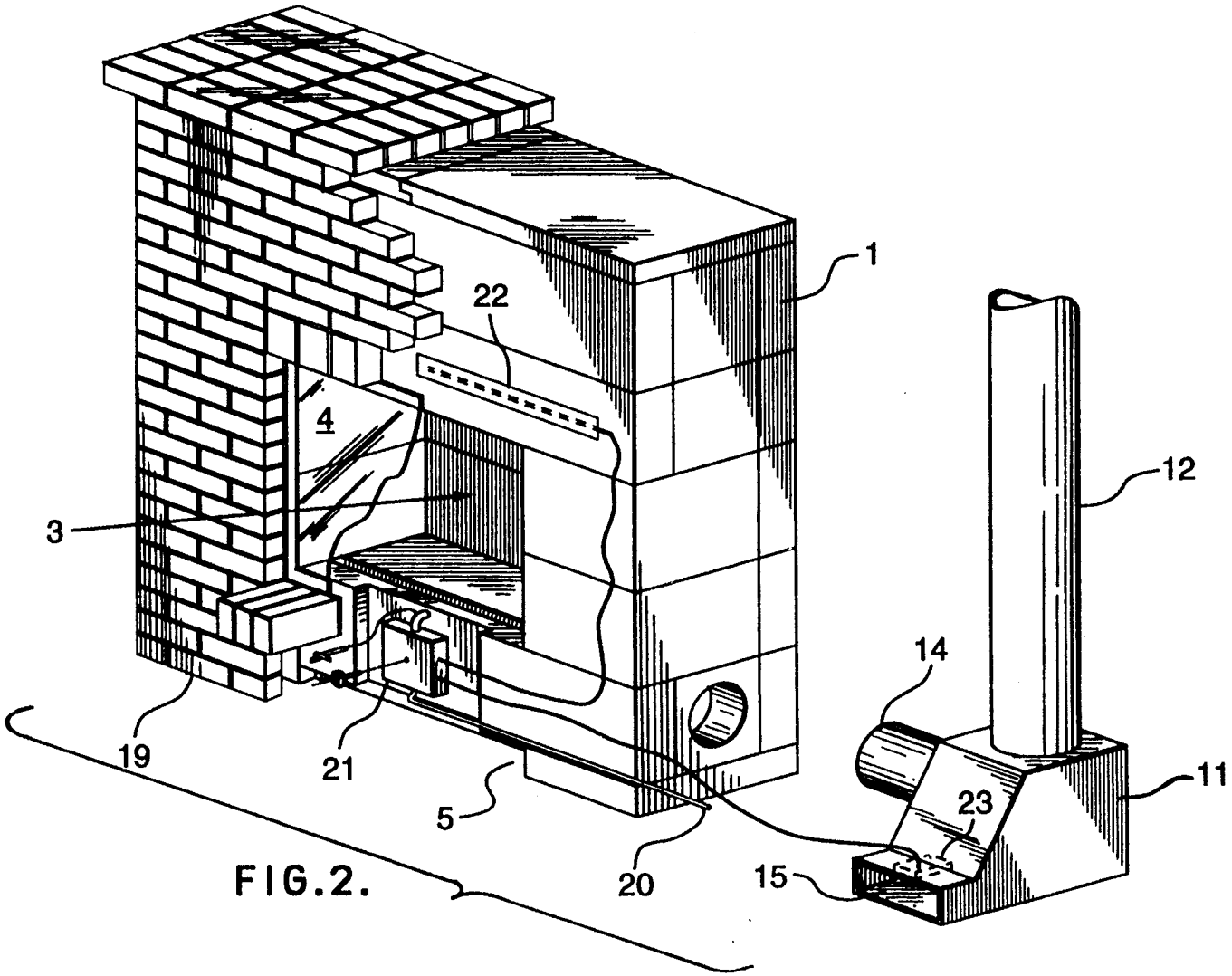
FIG. 2 is a like broken away perspective view showing a second embodiment of the invention adapted to include a gas fired burner showing a thermostat attached to the core of the masonry heater, gas burner control means and a temperature sensor within the relief port of the down draft hood for controlling the operation of the gas burner housed within the firebox.

FIG. 2 illustrates a preferred embodiment of the invention showing a masonry heater fueled by a gas burner 19 housed within the firebox 3. High efficiency gas burners having an imitation log design are available as inserts for conventional fireplaces. The burner 19 is supplied with fuel gas via a gas supply pipe 20 and a gas supply valve 21. The gas supply valve 21 includes means to control the burner which actuates the gas supply valve.

A thermostat 22 is positioned in contact with the refractory material of the masonry heater core 1. The thermostat is connected to the burner control means 21 and emits a stimulus to the burner control means. Depending upon the temperature of the refractory material therefore, the thermostat stimulates the burner control to ignite the burner, extinguish the burner, or vary the quantity of gas supplied to the burner. As a result the operation of a gas fired contra-flow masonry heater is thermostatically controlled in a automatic fashion similar to a conventional furnace. The user of the masonry heater therefore need only turn on the burner control means with the air tight door closed and need not attend to the operation of the masonry heater.

Within the relief port 15 of the down draft hood 11 is provided a temperature sensor 23. The temperature sensor 23 communicates with the burner control 21. When a temperature higher than a prescribed valve is detected, the temperature sensor stimulates the burner control to extinguish the burner. Therefore when a down draft condition exists, the exhaust gases from the exhaust inlet 14 are forced through the relief port 15. The temperature sensor detects a rise in temperature and stimulates the burner control to extinguish the burner. As a result carbon monoxide or other dangerous components of the exhaust gas are not exhausted to a significant degree through the relief port 15.

Of greater importance, due to the provision of a down draft hood 11, the down draft condition does not force outside air backward through the masonry heater which would force fuel gas and combustion gases backward through the air intake 5.

Figure 5:
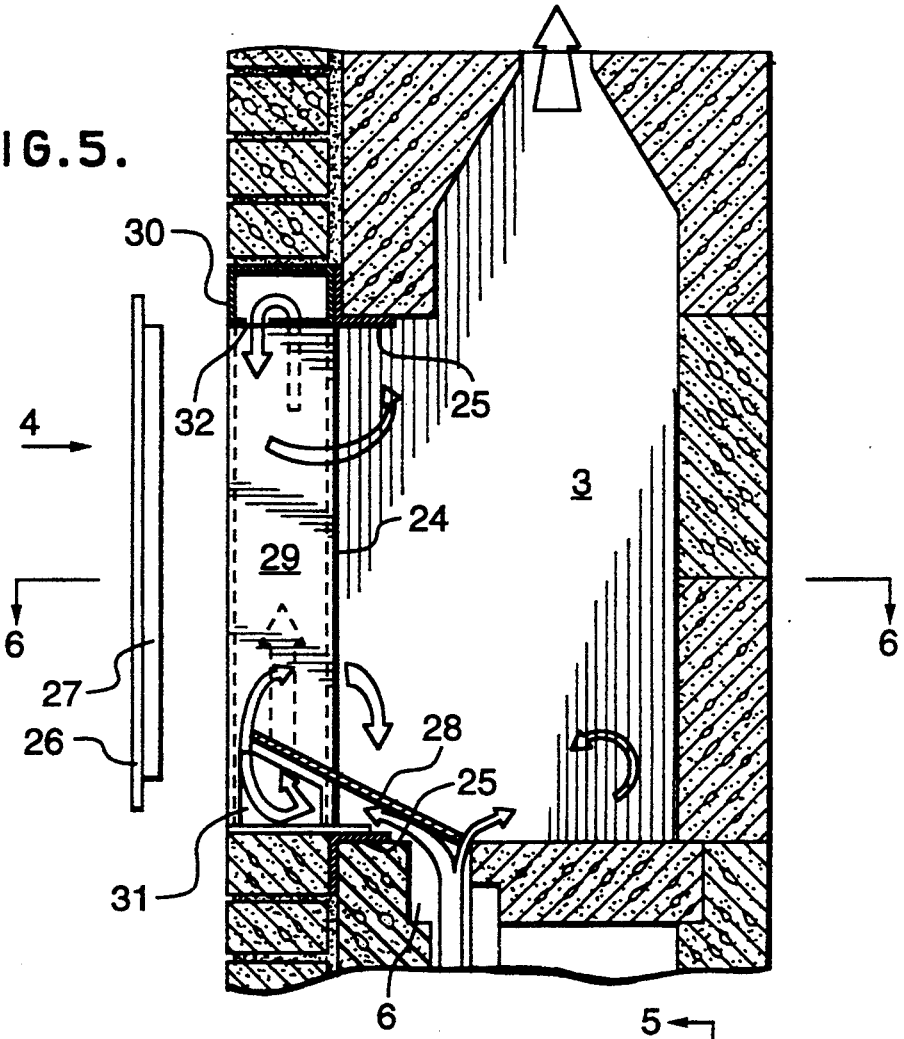
FIG. 5 is a vertical sectional view through the door and firebox (showing the door exploded away for clarity), as indicated by lines 5—5 in FIG. 6.
Figure 6:
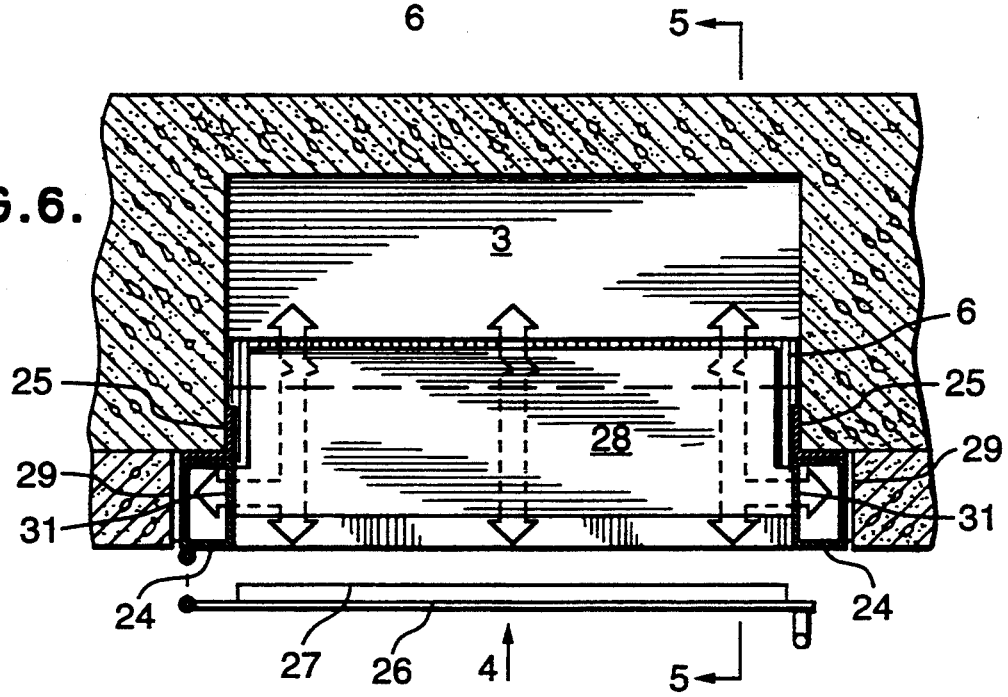
FIG. 6 is a plan sectional view through the door and firebox as indicated by lines 6—6 of FIG. 5.

Referring to FIGS. 5 and 6, the details of the door 4 are illustrated. The door 4 advantageously includes means to divert eh intake air against the inner surface of the door. As shown by the arrows of FIG. 5 the turbulence within the firebox 3 is increased thus improving the efficiency of combustion. A common problem with glass doors on wood burning or gas fired heaters is that the glass accumulates combustion products and becomes discolored. Glass also becomes discolored when high combustion temperatures are used since typically the glass may tolerate only a temperature of approximately 1,400° F. whereas optimal burning occurs at 1,800° F. typically. The flow of air past the inward surface of the door therefore has the added advantage of cooling the door surface, preventing contact between the door and combustion gases, and preventing the buildup of discoloring combustion products.

The door 4 includes a door frame 24 secured to the front opening of the firebox 3 with an angle iron flange 25 as illustrated. A door panel 26 is hinged to the door frame 24 and supports a central glass pane 27.

A diverter plate 28 extends over a portion of the firebox air intake slot 6 as shown by the arrows in FIGS. 5 and 6, an air wash portion of the intake air flow is diverted upwardly across the width of the bottom of the door panel 26. The air wash portion as illustrated in FIG. 5 swirls in a clockwise direction opposite to the counterclockwise direction of the remaining intake air flow which enters the firebox 3.

The door frame 24 includes two hollow tubular side members 29. The interior of each tubular side member 29 communicates with the interior of a like hollow top member 30. Each side member 29 has an air wash inlet 31 at a base end of each side member 29.

As indicated by hidden arrows in FIG. 5 in dotted outline, a part of the air wash portion is diverted through the air wash inlet 31 upwardly through the interior of the hollow side members 29 and into the interior of the hollow top member 30. The top member 30 has air wash outlets 32 which divert said part of the air wash portion downwardly across the width of the top of the door panel 26. As shown in FIG. 5 the downward motion of the air wash through the air wash outlet 32 results in a counterclockwise swirling action. The net result of the opposing swirling air masses is increased turbulence, cooling of the door panel 27 surface and effective separation of the combustion gases and the door panel 27. Discoloration and overheating of the glass pane 27 is thereby reduced.

In the embodiment illustrated the air wash outlet comprises a longitudinal slot 32 in the bottom face of the top member 30 however individual openings or nozzles may also be used.

FIGS. 7 through 10 illustrate the method by which the height of the contra-flow masonry heater core 1 can be increased. By simply stacking additional courses of modules and alternately inverting them, a secondary combustion chamber 8 and a tertiary combustion chamber 33 may be formed from standard modules. If desired, the secondary and tertiary combustion chambers 8 and 3 may be formed as approximate triangle prisms as in FIG. 8 or as hourglass prismatic forms as in FIGS. 9 and 10. The turbulence within the secondary and tertiary combustion chambers 8 and 33 and the resultant heat transfer characteristics to the masonry heater core 1 may be varied depending upon the shape of combustion chamber chosen. An additional advantage of course is that the vertical length of the heat exchange channels 9 are extended which also results in increased heat transfer characteristics.

Figure 10:
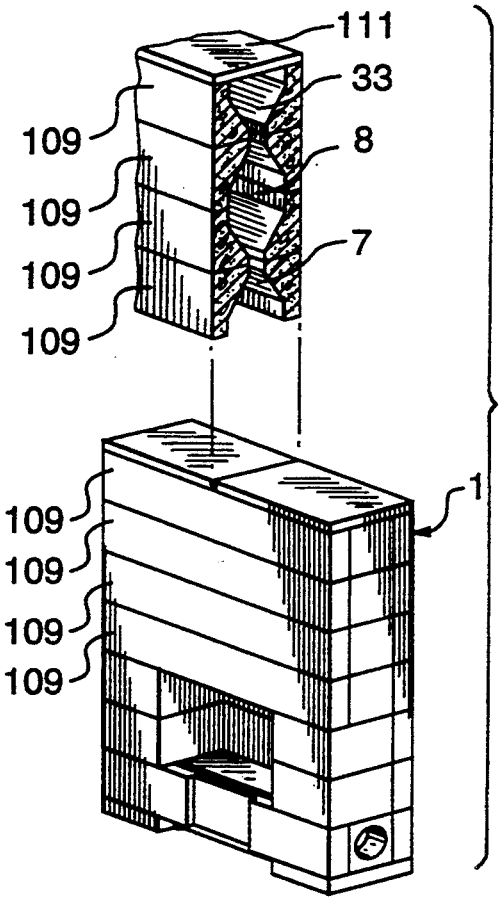
Figure 11H:
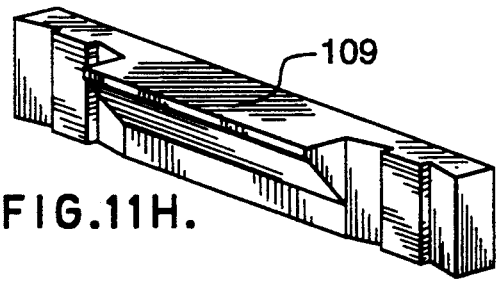
FIG. 11 shows perspective views of the individual modules which are used to construct the core of the masonry heater.
Figure 11I:
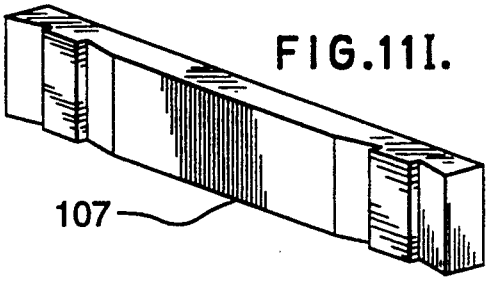
Figure 11G:
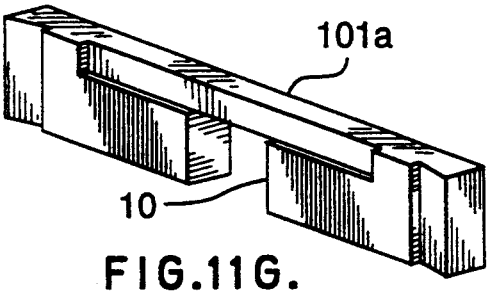
Figure 11J:
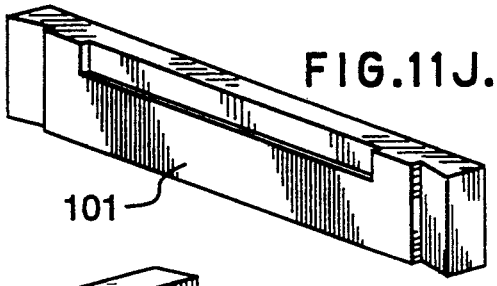
Figure 11K:
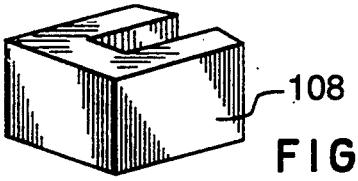
Figure 11F:
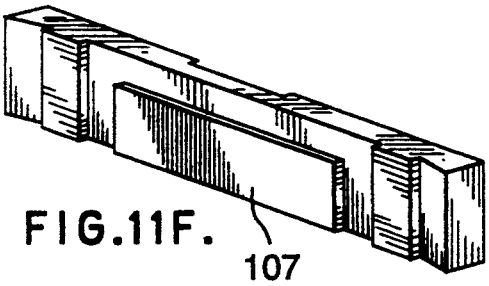
Figure 11L:
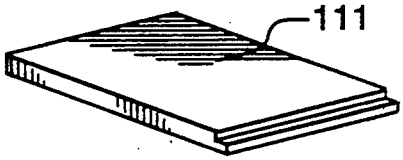
Figure 11D:
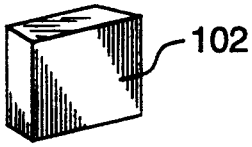
Figure 11E:
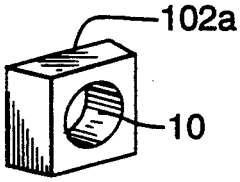
Figure 11M:
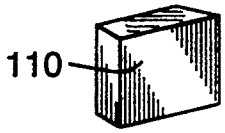
Figure 11B:
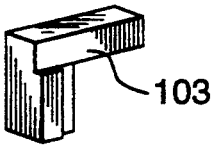
Figure 11C:
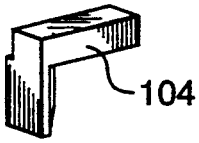
Figure 11N:
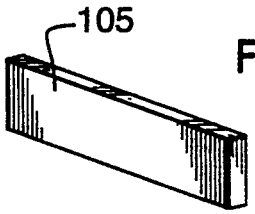
Figure 11A:
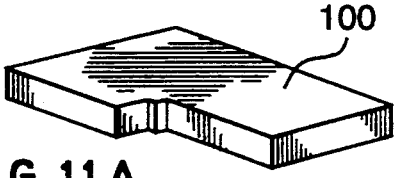
Figure 11O:
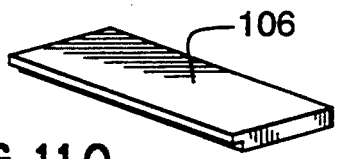

For example, as shown in FIG. 10 the firebox includes a tertiary combustion chamber 33 between the secondary combustion chamber 8 and the contra-flow channels 9. In theory any number of multiple combustion chambers may be provided. Outlets ports between such combustion chambers and the laterally adjacent vertical channels may be provided by simply choosing amongst the various components of the system.

Figure 8:
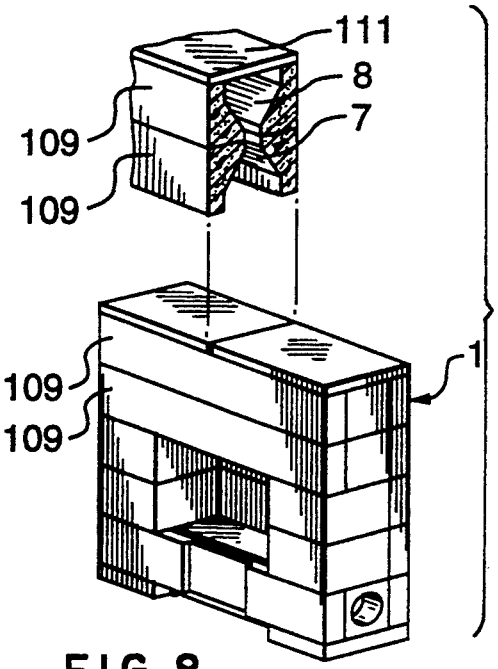
Figure 9:
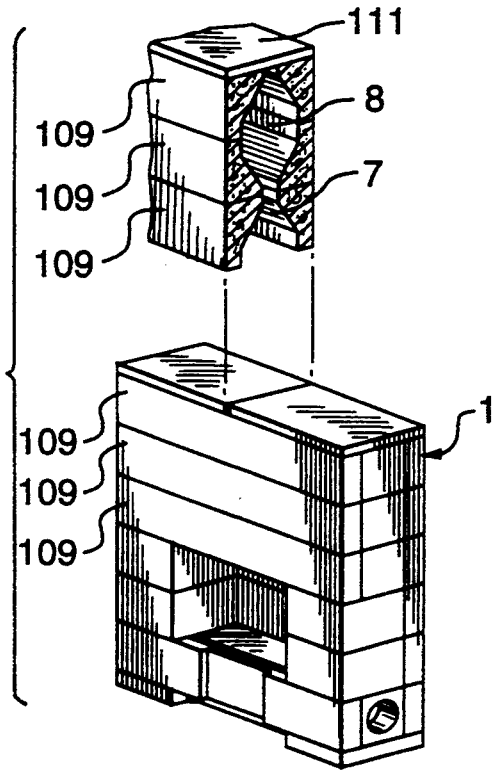

The step by step construction of a masonry core as shown for example in FIG. 8, will be described below. FIG. 11 shows detailed perspective views of each precast module of refractory material.

By vertically stacking a series of module blocks, the masonry heater core may be formed. As will be noted every block has the same vertical height and each block has walls of substantially equal thickness. It will also be noted that each block is joined to at least one block of the same course with a dovetail joint. For the purposes of this description therefore, the modules 100, 105, 106 and 111 will be described as plates whereas the remaining modules of equal vertical height and equal wall thickness are described as module blocks.

Figure 12:
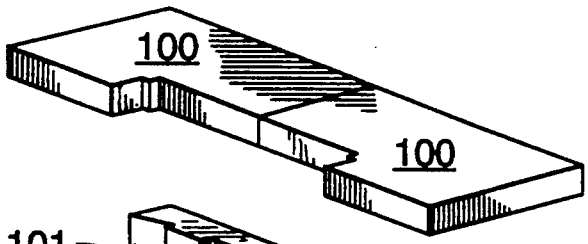
FIGS. 12 through 37 show a step by step construction of a masonry heater as illustrated in FIG. 8, showing the placement of each module.
Figure 13:
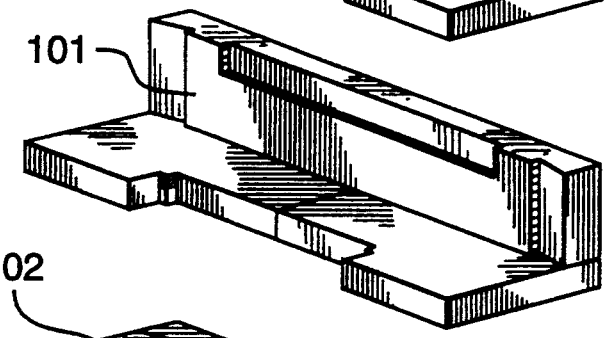

The first step in the assembly process is shown in FIG. 12 wherein two identical modules 100 are assembled to form a base plate. FIG. 13 shows the next step of installing module 101. In the retrofit application illustrated in FIGS. 38 and 39, the exhaust port 10 is located in the back wall of the heater. In such an application module 101*a* is installed in replacement of module 101 in FIG. 13.

Figure 14:
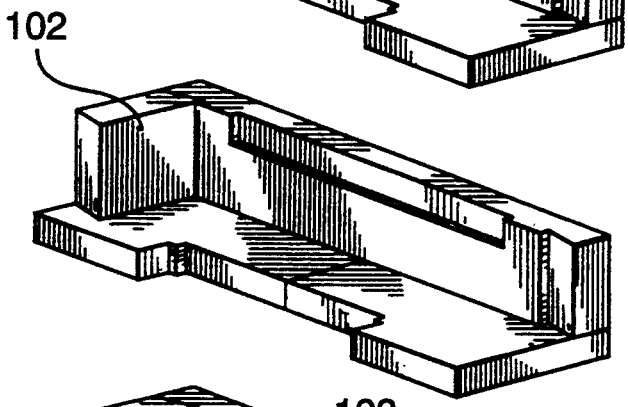
Figure 15:
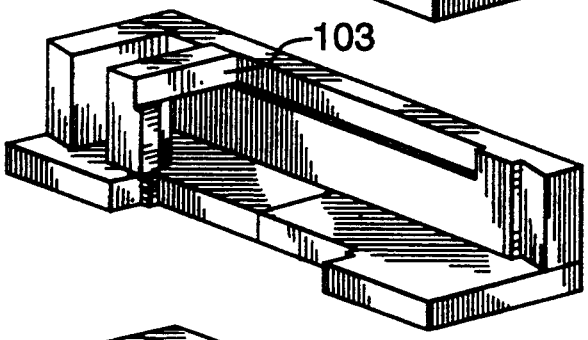
Figure 16:
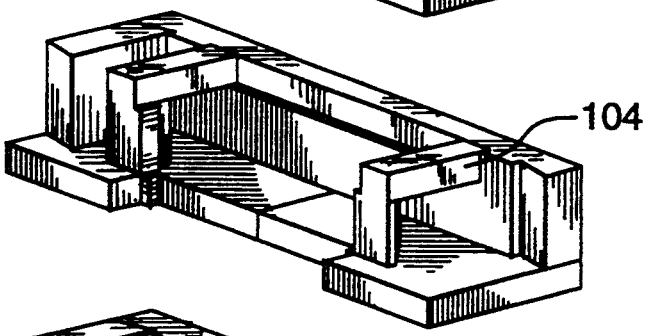

FIG. 14 shows the installation of side wall module 102. Next as shown in FIGS. 15 and 16, L-shaped modules 103 and 104 are inserted to support the firebox floor.

Figure 17:
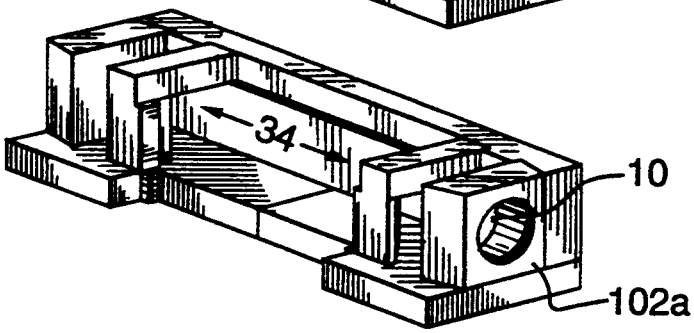

Since in the embodiment illustrated the exhaust port 10 exists from the right bottom portion of the side wall of the heater, FIG. 17 shows the installation of module 102*a* which includes the exhaust port 10.

Figure 18:
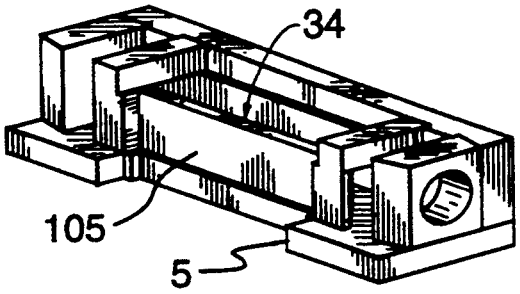
Figure 19:
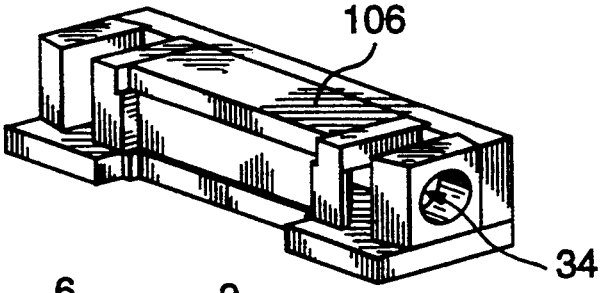
Figure 20:
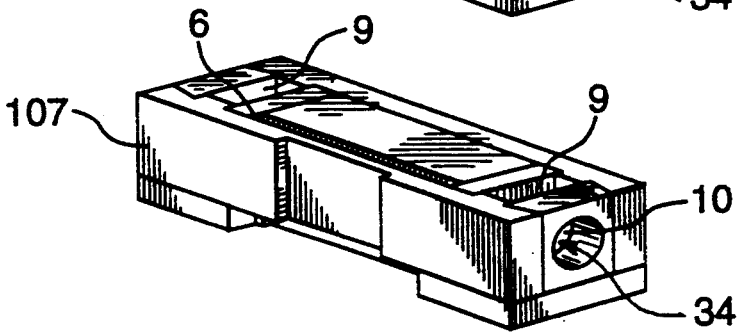

The formation of the air intake 5 and slot 6 is shown in FIGS. 18, 19 and 20. The rearward wall of the slot 6 is formed by the insertion of module 105. The firebox floor is completed as shown in FIG. 19 by the positioning of module 106. The forward face of the slot 6 is formed by the placement of module 107 as shown in FIG. 20.

As will be apparent from the description below, the masonry heater illustrated includes two vertical contra-flow heat exchange channels 9 which are laterally adjacent the firebox 3. A flue gas manifold 34 is formed as shown in FIG. 20 communicating among the bottom portion of both channels 9 and the exhaust port 10. The manifold 34 extends beneath the firebox 3 from one side of the heater to an opposite side. As a result of the manifold 34, the exhaust port 10 may be located in modules 102*a* on either side of the heater or in the back wall of the heater through the use of module 101*a* as described above.

Figure 21:
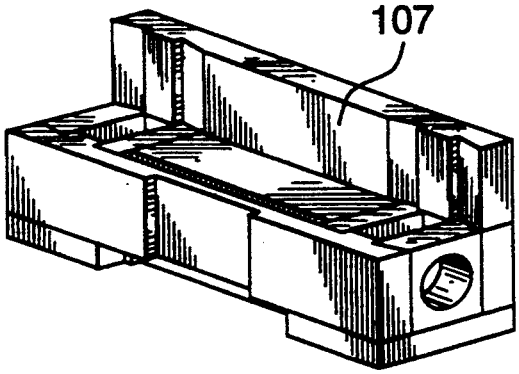
Figure 22:
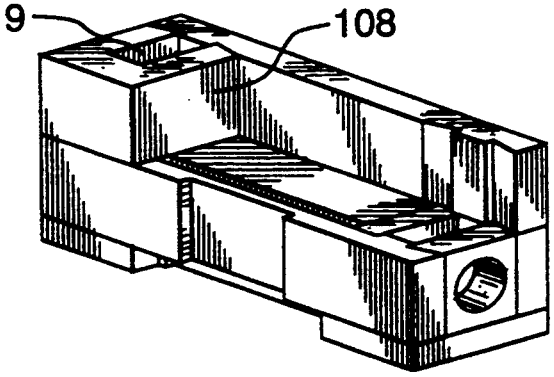
Figure 23:
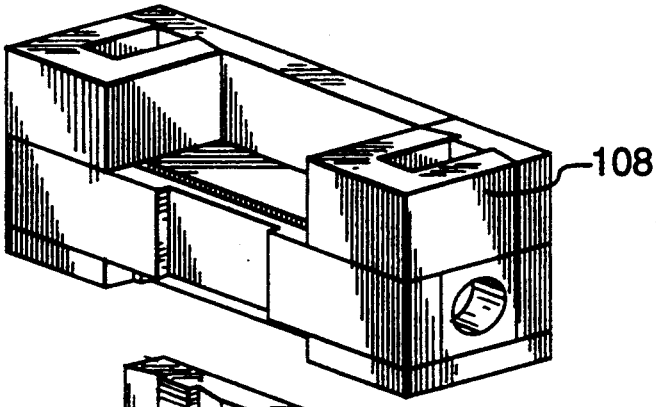
Figure 24:
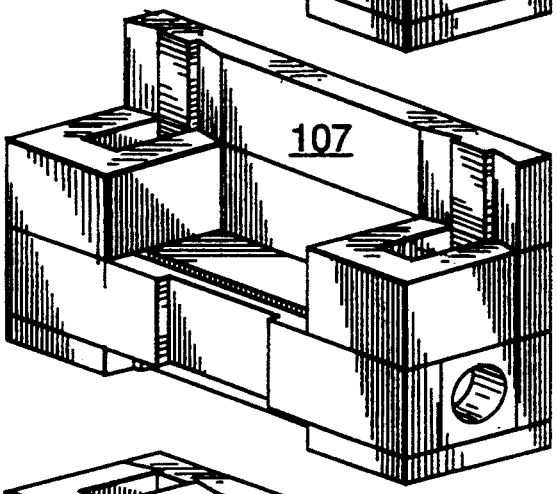
Figure 25:
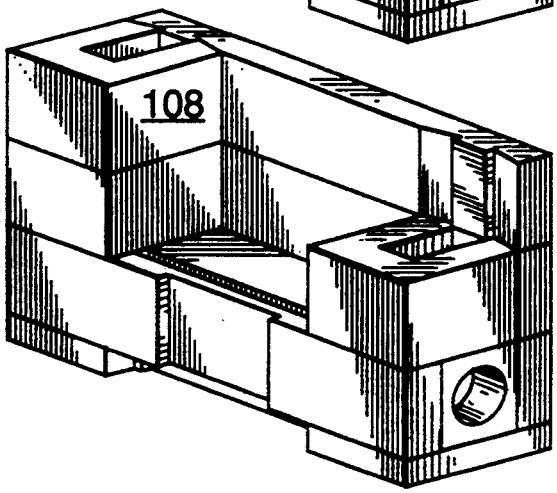
Figure 26:
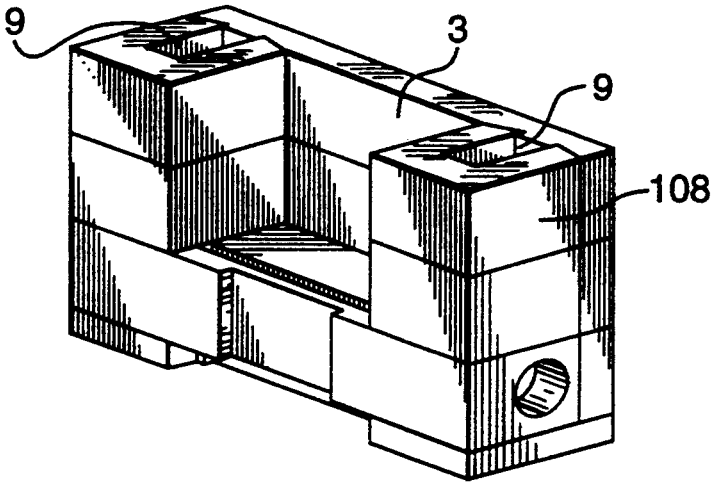
Figure 27:
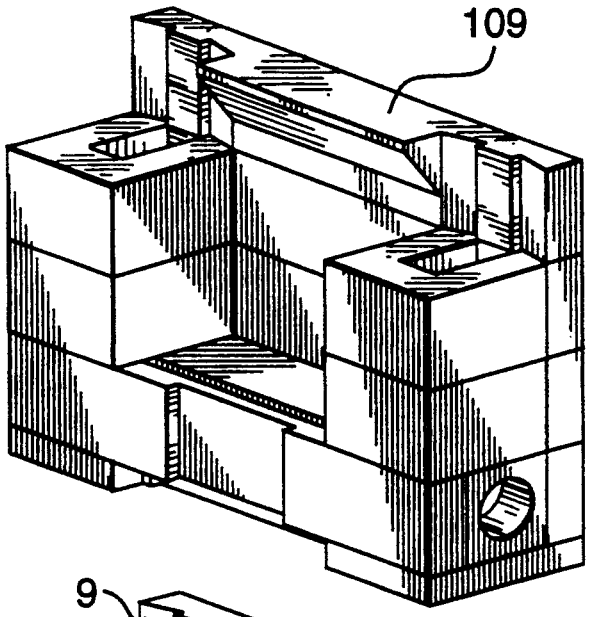
Figure 28:
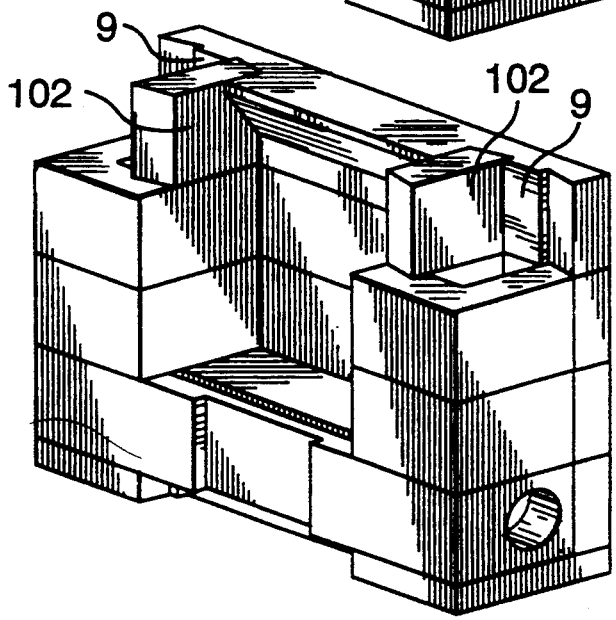
Figure 29:
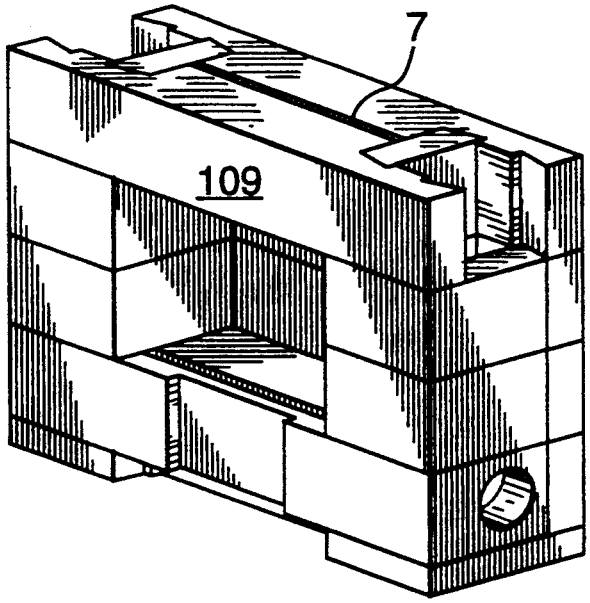
Figure 30:
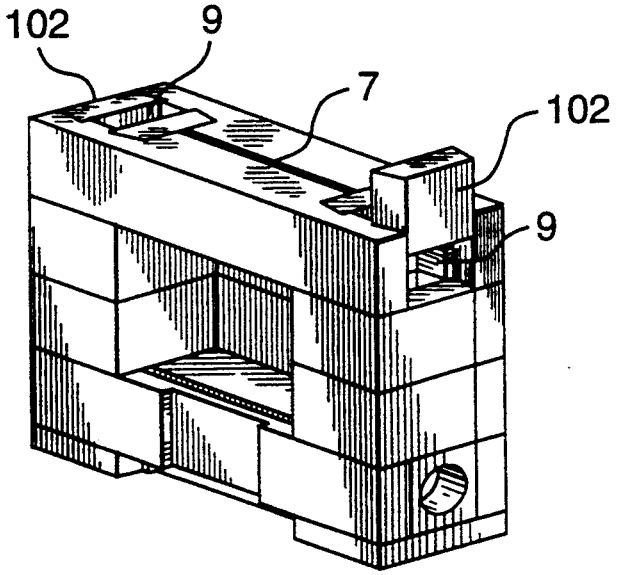

Referring to FIG. 21, the construction of a second and third course of blocks is commenced. As shown in FIGS. 21 through 26, the placement of modules 107 and 108 in a second and third course of blocks forms the firebox 3 and a lower portion of the channels 9.

FIGS. 27 through 30 show the installation of a fourth course of blocks which forms an upperwardly tapering upper flue outlet 7 and further increases the height of the channels 9 through the placement of modules 109 and 102.

Figure 31:
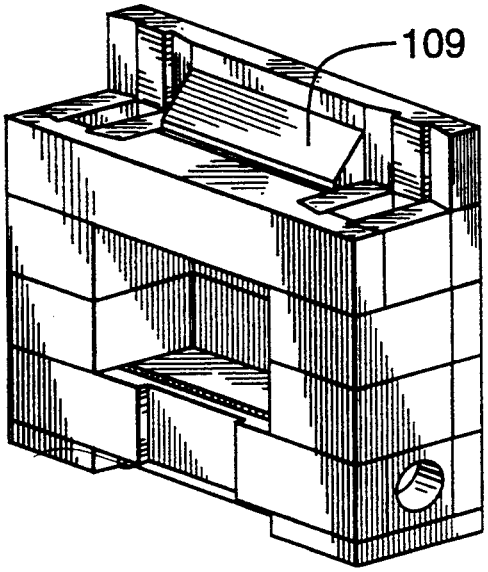
Figure 32:
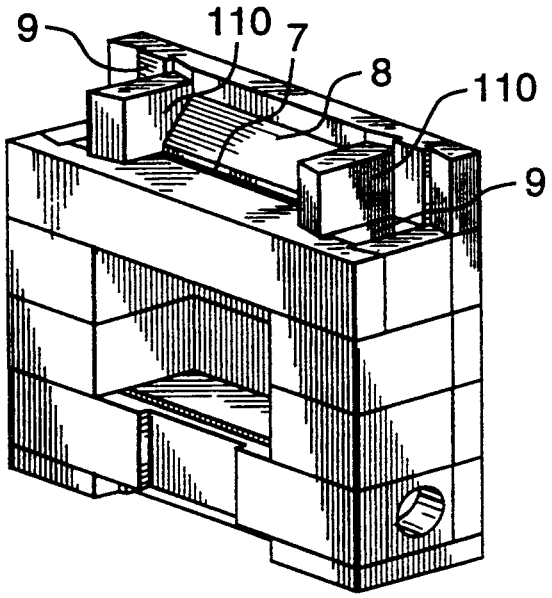

As illustrated in FIGS. 31 through 35, the fifth course of blocks forms a secondary combustion chamber 8 between the flue outlet 7 and the contra-flow channels 9. Module 109 is installed in an inverted position as shown in FIG. 31. Modules 110 are positioned to form the interior walls of the channels 9. It will be noted that the vertical height of module 110 is marginally less than the height of modules 102 and 109. As a result, module 110 acts as a weir over which flue gases may escape. Flue gases flow from the flue outlet 7 into the secondary combustion chamber 8, over the top wall of module 110 and thereafter downward through the vertical channels 9.

Figure 33:
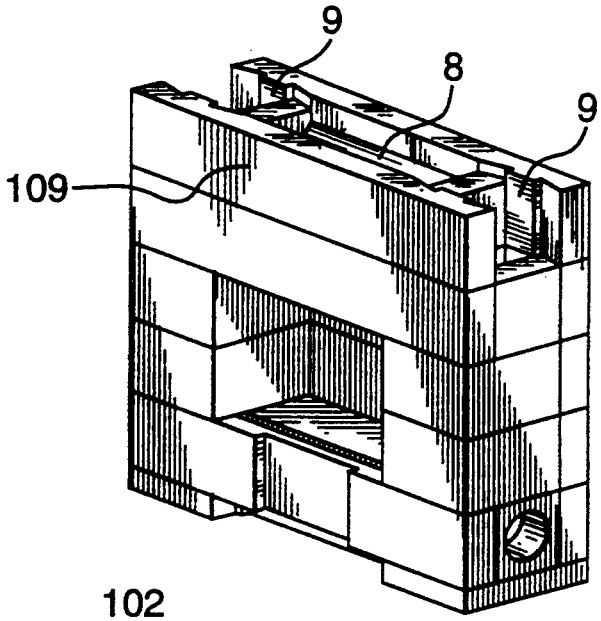

A second block module 109 is installed in an inverted position and shown in FIG. 33.

Figure 34:
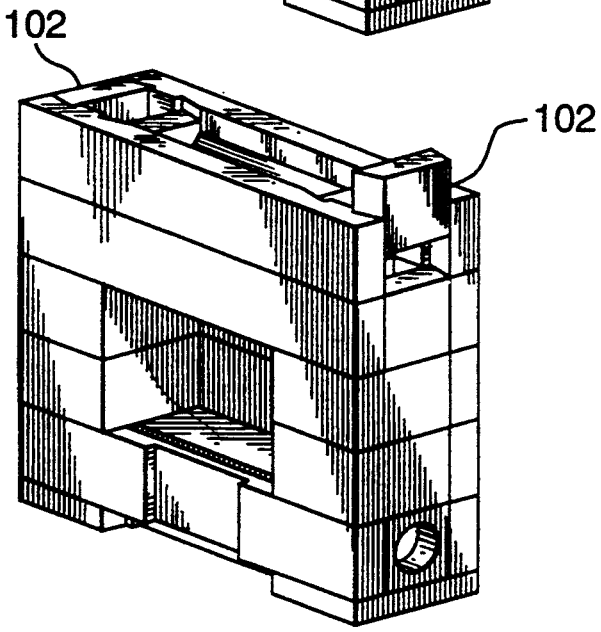
Figure 35:
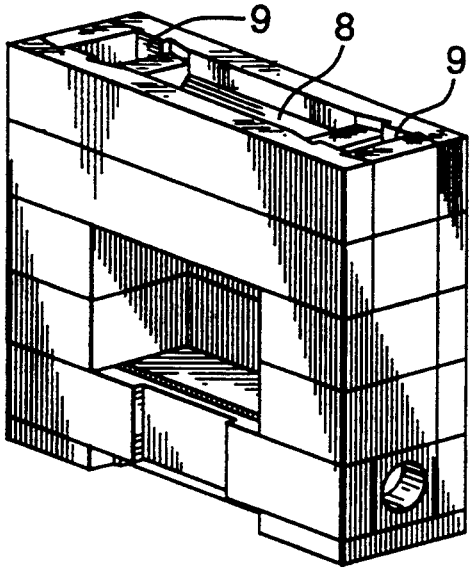
Figure 36:
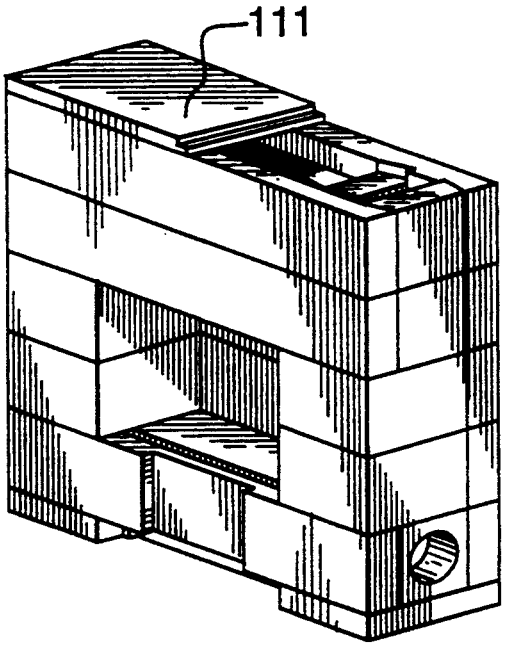
Figure 37:
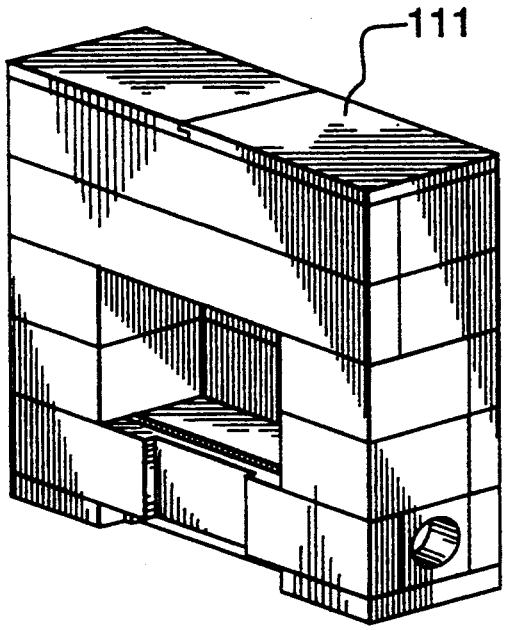

The outward walls of the vertical channels 9 are completed with the insertion of modules 102 as shown in FIG. 34. A double bead of silicon caulking is applied to the top surface of the last course of blocks as shown in FIG. 35. Cap blocks 111 form a cap plate with a ship-lap joint between them to securely seal the top surface of the masonry heater core as shown in FIGS. 36 and 37.

As illustrated in FIG. 10 a sixth and seventh course of block modules 109 may be used to form a tertiary combustion chamber 33 between the flue outlet 7 and the contra-flow channels 9.

Figure 7:
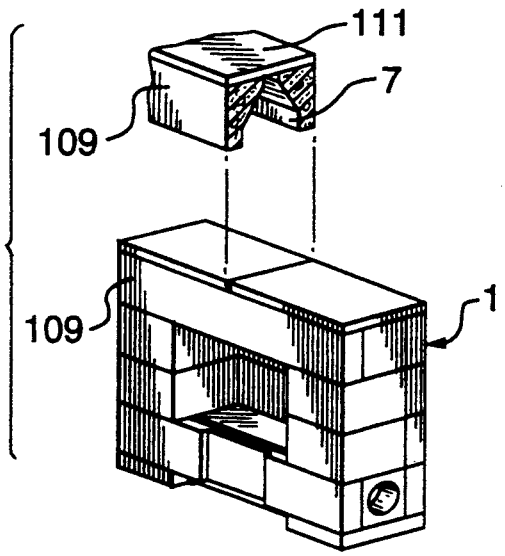
FIG. 7 through 9 are all perspective views of the core of a masonry heater according to the invention showing from left to right the addition of modules to increase the height of the masonry heater thereby adding secondary and tertiary combustion chambers and lengthening the heat exchange channels on the sides of the firebox.

As illustrated in FIG. 7 it is not necessary to include a secondary combustion chamber 8 for example if height restrictions prevent any increased height for the masonry core 1.

Figure 38:
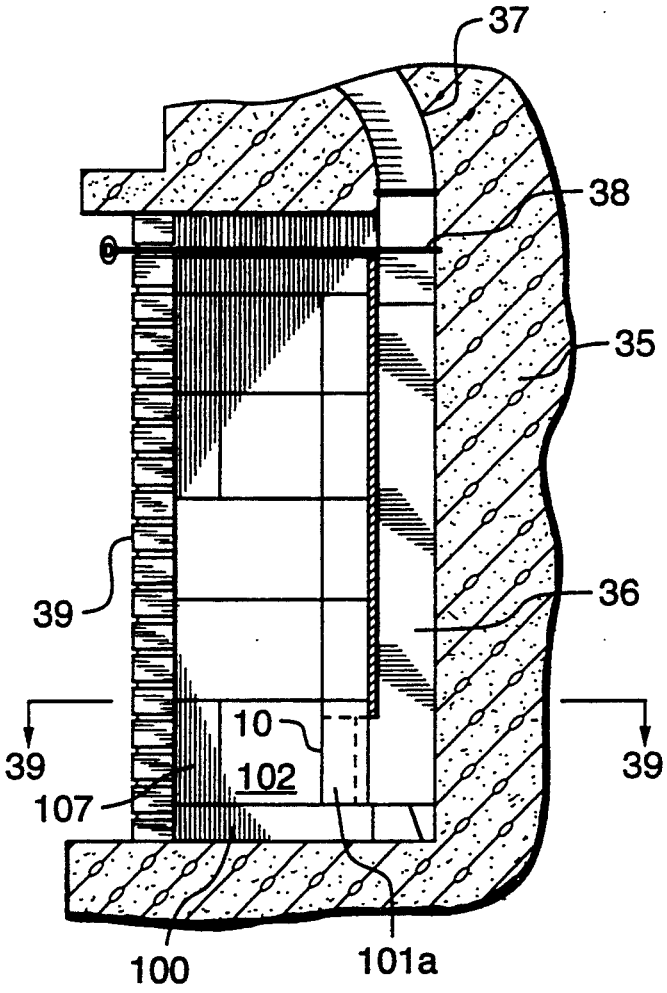
FIG. 38 shows the installation of a masonry heater core as illustrated in FIG. 8, retro fitted within the hearth of a conventional fireplace.
Figure 39:
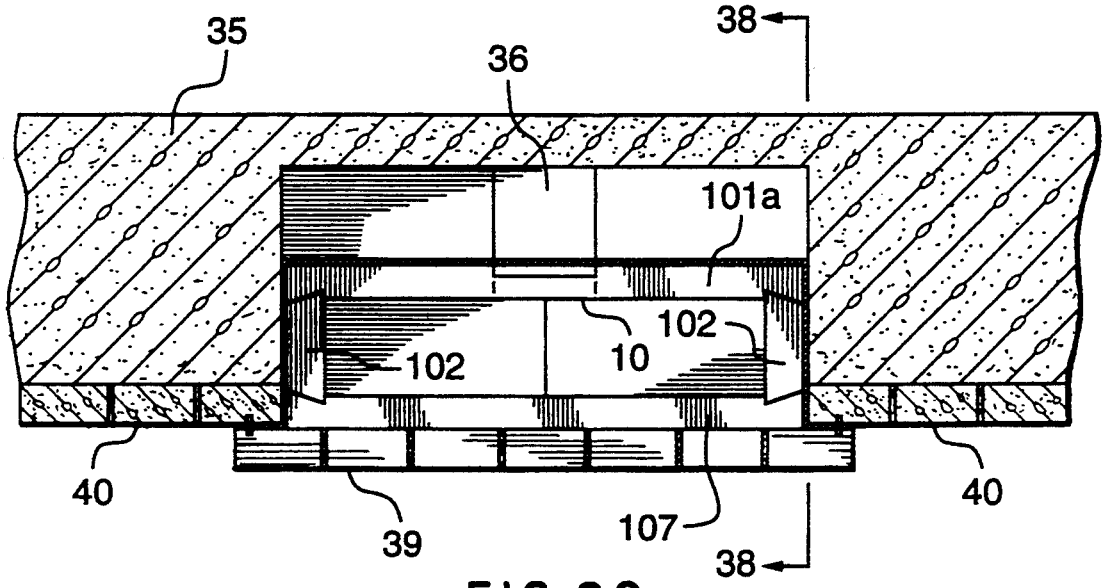
FIG. 39 shows a plan sectional view of the retro fitted installation as indicated by lines 39—39 of FIG. 38.

Referring to FIGS. 38 and 39 a masonry heater core 1 may be adapted for retrofitting into an existing fireplace hearth 35. The core 1 illustrated in FIGS. 38 and 39 correspond exactly to that illustrated in FIG. 8 with the exception that the exhaust port 10 is located in the back wall of the heater as opposed to the side wall of the heater. As described above, when constructing the first course of blocks, module 101*a* replaces module 101 to include the exhaust port 10 in the rear wall of the heater. On both side walls, modules 102 are used rather than module 102*a*. A chimney liner 36 communicates between the exhaust port 10 and the flue 37 of the existing hearth 35.

A damper 38 may be provided within the liner 36 to control combustion. As most clearly shown in FIG. 39, a brick facade 39 may be applied to the surface of the retrofitted masonry heater core 1 to continue the existing facade 40 of the hearth 35 to be retrofitted.

It will be understood that, although various features of the invention have been described with respect to one or another of the embodiments of the invention, the various features and embodiments of the invention may be combined or used in conjunction with other features and embodiments of the invention as described and illustrated herein.

The embodiments of the invention in which an exclusive property or privilege is claimed are defined as follows:

1. A contra-flow masonry heater comprising:

a firebox having a front opening, an air intake communicating with a source of fresh air and an upper flue outlet;

at least one vertical contra-flow heat exchange channel communicating between the flue outlet and an exhaust port, the firebox and channel having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air;

an air tight door secured to the front opening of the firebox;

a gas burner housed within the firebox, the burner communicating with a source of fuel gas via a gas supply valve;

burner control means for actuating the gas supply valve;

thermostat means in contact with the refractory material and the burner control means, for stimulating the burner control means to ignite, extinguish, and vary the quantity of gas supplied to the burner; and temperature sensor means, within the relief port of the down draft hood and communicating with the burner control means, for stimulating the burner control means to extinguish the burner when a temperature higher than a prescribed valve is detected.

2. A masonry heater according to claim 1 wherein the firebox includes a secondary combustion chamber between the upper flue outlet and the contra-flow channel.

3. A masonry heater according to claim 2 wherein the firebox includes a tertiary combustion chamber between the secondary combustion chamber and the contra-flow channel.

4. A contra-flow masonry heater comprising:

a firebox having a front opening, an air intake communicating with a source of fresh air and an upper flue outlet;

two vertical contra-flow heat exchange channels laterally adjacent the firebox communicating with the flue outlet;

a flue gas manifold having an exhaust port, the manifold communicating among a bottom portion of both of the channels and the exhaust port and extending beneath the firebox from one side of the heater to an opposite side;

the firebox and channels having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air;

an air tight door secured to the front opening of the firebox.

5. A masonry heater according to claim 4 wherein the exhaust port is located in a back wall of the heater.

6. A masonry heater according to claim 4 wherein the exhaust port is located in a side wall of the heater.

7. A contra-flow masonry heater comprising:

a firebox having a front opening, an air intake communicating with a source of fresh air and an upper flue outlet;

at least one vertical contra-flow heat exchange channel communicating between the flue outlet and an exhaust port, the firebox and channel having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air;

an air tight door secured to the front opening of the firebox, said door comprising: a door frame secured to the front opening of the firebox; a door panel hinged to the door frame, the door panel supporting a central glass pane; and diverter plate means, extending over a portion of the firebox air intake, for diverting an air wash portion of intake air flow upwardly across the width of the bottom of the door panel;

wherein the door frame includes at least one hollow tubular side member, the interior of which communicates with the interior of a hollow top member, each side member having an air wash inlet at a base end thereof, the top member having air wash outlet means for diverting a part of said air wash portion, from the air wash inlet, downwardly across the width of the top of the door panel.

8. A masonry heater according to claim 7 wherein the air wash outlet means comprises a longitudinal slot in the bottom face of the top member.

9. A contra-flow masonry heater comprising:

a firebox having a front opening, an air intake communicating with a source of fresh air and an upper flue outlet;

two vertical contra-flow heat exchange channels laterally adjacent the firebox communicating with the flue outlet;

wherein the firebox and channels are constructed of pre-cast modules comprising: a base plate; a vertically stacked series of modular blocks, every block being of the same vertical height and having walls of substantially equal thickness, each block of each course being joined to at least one block of the same course with a dovetail joint; and a cap plate and wherein the the base plate and a first course of blocks forms a flue gas manifold having an exhaust port, the manifold communicating among both of the channels and the exhaust port and extending beneath the firebox from one side of the heater to an opposite side;

the firebox and channels having walls of refractory material for mass absorption of heat energy from a burning fuel and combustion gases contained therein and subsequent radiant release of heat energy to an adjacent space, a down draft hood communicating between the exhaust port and outside air, the down draft hood having a plenum communicating among an exhaust inlet, a chimney and a relief port, the relief port being located below the elevation of the exhaust inlet and communicating with the source of fresh air; and an air tight door secured to the front opening of the firebox.

10. A masonry heater according to claim 9 wherein the second and a third course of blocks forms the firebox and a lower portion of the channels.

11. A masonry heater according to claim 10 wherein the fourth course of blocks forms an upwardly tapering upper flue outlet.

12. A masonry heater according to claim 11 wherein a fifth course of blocks forms a secondary combustion chamber between the flue outlet and the contra-flow channels.

13. A masonry heater according to claim 12 wherein a sixth and seventh course of blocks forms a tertiary combustion chamber between the flue outlet and the contra-flow channels.

14. A masonry heater core adapted for retrofitting into an existing fireplace hearth, the core comprising:

a firebox having a front opening, an air intake communicating with a source of fresh air and an upper flue outlet;

two vertical contra-flow heat exchange channels communicating with the flue outlet;

the firebox and channels having walls of refractory material for mass absorption of heat energy from a burning fuel and combustion gases contained therein and subsequent radiant release of heat energy to an adjacent space, the channels being laterally adjacent the firebox;

a flue gas manifold having an exhaust port, the manifold communicating among a bottom portion of both of the channels and the exhaust port and extending beneath the firebox from one side of the heater to an opposite side, the exhaust port being located in a rear wall of the core;

a chimney liner communicating between the exhaust port and a chimney flue of said existing hearth, the liner including a down draft hood having a plenum communicating among an exhaust inlet, the chimney flue and a relief port, the relief port being located below the elevation of the exhaust port and communicating with the source of fresh air;

an air tight door secured to the front opening of the firebox;

a gas burner housed within the firebox, the burner communicating with a source of fuel gas via a gas supply valve;

burner control means for actuating the gas supply valve;

thermostat means in contact with the refractory material and the burner control means, for stimulating the burner control means to ignite, extinguish, and vary the quantity of gas supplied to the burner; and temperature sensor means, within the relief port of the down draft hood and communicating with the burner control means, for stimulating the burner control means to extinguish the burner when a temperature higher than a prescribed valve is detected.

15. A masonry heater according to claim 14 including a damper within said liner.

* * * * *